United States Patent [19]

Burnett, Jr. et al.

[11] 4,250,001

[45] Feb. 10, 1981

[54] PRETREATMENT OF CATHODES IN ELECTROHYDRODIMERIZATION OF ACRYLONITRILE

[75] Inventors: Joseph C. Burnett, Jr., Manchester, Mo.; William A. Heckle, Pensacola, Fla.

[73] Assignee: Monsanto Company, St. Louis, Mo.

[21] Appl. No.: 50,266

[22] Filed: Jun. 19, 1979

[51] Int. Cl.[3] ..... C25B 3/10; C25B 11/00

[52] U.S. Cl. ..... 204/73 A; 204/290 R

[58] Field of Search ..... 204/73 R, 73 A, 292, 204/290 R

[56] References Cited

U.S. PATENT DOCUMENTS

| | | | |
|---|---|---|---|
| 3,616,321 | 10/1971 | Verheyden et al. | 204/73 A |
| 3,960,697 | 6/1976 | Kircher et al. | 204/252 |
| 4,155,818 | 5/1979 | Campbell et al. | 204/73 A |

FOREIGN PATENT DOCUMENTS

| | | | |
|---|---|---|---|
| 1089707 | 11/1967 | United Kingdom | 204/73 A |

*Primary Examiner*—F. C. Edmundson

*Attorney, Agent, or Firm*—Thomas Y. Awalt, Jr.

[57] ABSTRACT

An improvement in the process of electrohydrodimerizing acrylonitrile to adiponitrile wherein metal-plated cathodes, which are employed in the process as a part of an electrolytic cell, are pretreated by wetting the cathodes with aqueous phosphoric acid thereby to significantly reduce fouling.

5 Claims, 1 Drawing Figure

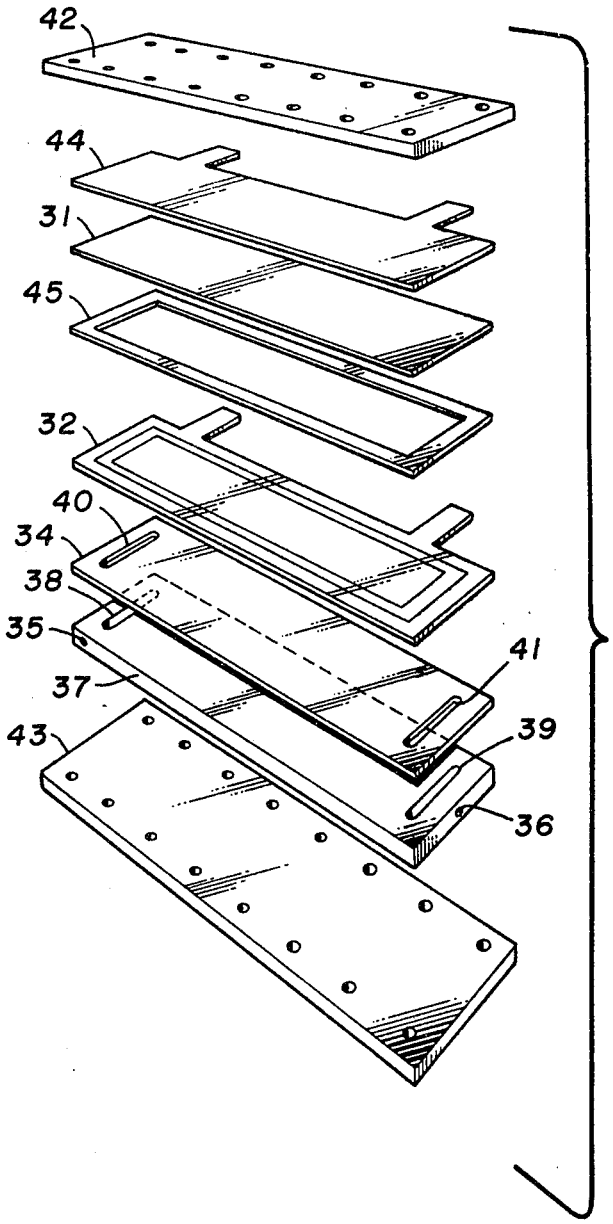
42
44
31
45
32
40
34
38
35
37
43
41
39
36

PRETREATMENT OF CATHODES IN ELECTROHYDRODIMERIZATION OF ACRYLONITRILE

BACKGROUND OF THE INVENTION

A. Field of the Invention

The invention relates to the production of adiponitrile from acrylonitrile by electrochemical synthesis, and particularly to an improvement in such a process wherein the cathodes are pretreated with phosphoric acid.

B. Background of the Invention

The reduction of acrylonitrile to adiponitrile by electrohydrodimerization is taught in British Pat. No. 1,089,707 (to Tomilov). In such a reaction, it is often preferred to use cathodic surface metals selected for high hydrogen over-voltage, and although metals such as lead, thallium, zinc, mercury and cadmium are preferred, because of the expense of the material and the lack of strength of these materials, it is common practice to electroplate the desired metal on a more suitable metal such as steel which is strong, readily available and inexpensive. A suitable cathode, for example, for the electrohydrodimerization of acrylonitrile to adiponitrile is cadmium-plated steel.

SUMMARY OF THE INVENTION

This invention is an improvement in the process for the production of adiponitrile from acrylonitrile by electrolytic dimerization in an electrolytic cell having a dimerization electrolyte and electrodes (anodes and cathodes), where at least a portion of the cathodes are metal-plated, and where the cathodes after prolonged exposure to the dimerization electrolyte during the electrolytic dimerization process became fouled, and where the fouling interfers with the electrolytic dimerization. The improvement comprises pretreating the cathode by wetting the surface of the cathode with aqueous phosphoric acid.

THE DRAWING

The FIGURE is an exploded assembly of an experimental electrode package of a type described in the examples which may be pretreated according to this invention.

DETAILED DESCRIPTION OF THE INVENTION

A description of a typical process for the production of adiponitrile from acrylonitrile, suitable for employment in conjunction with the improvement described herein, is contained in U.S. Pat. No. 3,960,697 (hereby incorporated by reference).

The electrolytic cell employed in the process described preferably comprises a cadmium-plated carbon steel cathode. The substrate of the metal-plated cathode (and the anode surface) preferably consists essentially of carbon steel as opposed as to iron, alloy steel or stainless steel. Carbon steel, as defined herein (and by the American Iron and Steel Institute [AISI]) is as follows: "carbon steel is classed as such when no minimum content is specified or guaranteed for aluminum, chromium, columbiumn, molybdenum, nickle, titanium, tungsten, vanadium, or zirconium; when the miniumum for copper does not exceed 0.40 percent; or when the maximum content specified or guaranteed for any of the following elements does not exceed the percentages noted: maganese 1.65; silicon 0.60, copper 0.60."

Although the cadmium plated carbon steel cathode is preferred from the point of view of economy and convenience, it has a tendency to foul much more rapidly than, for example, solid cadmium cathodes. Fouling is the deposition of foreign matter, predominatly anode corrosion materials (such as iron or iron oxide) during the reaction. Electroplated cadmium cathodes on carbon steel substrates, under ordinary circumstances, can become fouled within a few hours of electrohydrodimerization.

We have discovered that by pretreating the cadmium-plated surface with aqueous phosphoric acid, fouling of the cadmium cathode is significantly reduced. The reduction in fouling is accompanied by a significantly better selectivity to adiponitrile in the electrohydrodimerization process.

Pretreatment of the cathodes with any concentration of phosphoric acid solutions will be effective; but a range of 25–75 volume % water and 25–75 volume % concentrated phosphoric acid (85 weight %) is preferred.

Wherever it is necessary to pretreat cathodes in the presence of anodes, it may be desirable to employ an anode corrosion inhibitor. Where the anode is carbon steel, for example, 100–500 ppm potassium iodide may be included with the phosphoric acid solution to prevent excessive corrosion by the anode during the cathode pretreatment. The process improvement described above should be distinguished from cathode fouling removal which may also be required periodically. Pretreatment of the cathodes, as described herein contemplates (but does not require) that the cathode to be pretreated is a freshly cleaned or electroplated cathode. The physical effect of such pretreatment is not known; but it is believed to be decontamination, surface conditioning or a combination of such effects.

Referring in detail to the drawing, the essential portions of the simplified cell are cathode (31) and anode (32), which are separated by plastic spacer (45). A circulation chamber is defined by cathode (31), anode (32) and the inside perimeter of plastic spacer (45). The electroplating solution is fed through aperture (36) and slot (39) of polyethylene feed block (37) through slot (41) of neoprene gasket (34) to the aforementioned circulation chamber, and from the circulation chamber through slot (40) of neoprene bottom gasket (34), slot (38) of polyethylene feed block (37), and out through aperture (35) of polyethylene feed block (37), and out through aperture (35) of polyethylene feed block (37). The entire assembly, including plastic upper and lower plates (42) and (43) and conductor plate (44) is assembled in fixed parallel-planar relationship. Plastic spacer (45) assures uniform spacing of the element from cathode (31). Spacer (45), in this particular embodiment is 0.178 cm thick.

EXAMPLES

Two electrolysis units were used for the testing of the cadmium plated cathodes in the examples below, and consisted of a pump for circulating the aqueous sodium phosphate electrolyte which was mixed with an organic phase containing acrylonitrile and the reaction products. The electrolyte stream passed through a heat exchanger, between two electrodes spaced 70 mils apart, out of the cell through an off-gas disengaging vessel to a decanter where part of the organic layer was separated and removed as product, the remainder being recirculated along with acrylonitrile fed to the circulation pump, again to be pumped through the electrolysis cell. Typically the aqueous solution contained approximately 1.6% acrylonitrile, 1.2 adiponitrile, 0.2% acrylonitrile electrohydrodimerization by-products, $5.8\times10^3$ gram mole per liter of ethyltributylammonium cations, 10% of a mixture of incompletely-substituted sodium orthophosphates corresponding to the solution pH of 9 (approximately $Na_{1.9}H_{1.1}PO_4$), 0.1% of a ferrous metal corrosion inhibitor and 0.05% of tetrasodium ethylenediaminetetraacetate. Entrained in the solution was approximately 1% by weight of an organic phase containing about 54% adiponitrile, 29% acrylonitrile, 9% acrylonitrile dimerization byproducts and 8% water. A first unit (Unit 1) contained 2 electrolysis cells ("A" and "B"), with lengths of 24 inches, the cells running parallel one to another. The second unit (Unit 2) had only one cell and a track length of 12 feet. The structure of the cells was as shown in the Drawing.

EXAMPLE 1

(Comparative Example)

Cathodes plated from cadmium cyanide plating solution were installed in both cells of Unit 1. The unit was placed in operation for 70 hours, and then shut down due to excessive hydrogen generation. Both cathodes were excessively fouled. ;CL EXAMPLE 2

Identical cathodes to (showing effect of stains) those used in Example 1 were used in cells 1 and 2, except that in one of the cells, a cathode having a contrasting dark/-light area stain was employed. The stain was of unknown origin or consistency but is of a type that can be found on commercially manufactured cadmium plated electrodes. After 25 hours of running time, the unit was shut down due to excessive hydrogen formation. While the unstained cathode was fouled over less than 5% of its entire area, the stained cathode was fouled only on the areas stained dark.

EXAMPLE 3

A commercially produced cathode plated from a cadmium cyanide solution was placed in cell A of Unit 1; and a similarly plated cathode which had previously been washed with a 15 volume % water/15 volume % concentrated (85 weight %) phosphoric acid solution in three 2–3 inch stripes evenly spaced along the flow track, was placed in cell "B". Unit 1 was run for 40 hours before excessive hydrogen output required that the unit be shut down. All of the cathode in cell A was clean, and all of the washed stripes in cell B were clean, but the unwashed areas were heavily fouled causing the high hydrogen output.

EXAMPLE 4

(Comparative Example)

A commercial cadmium cathode (carbon steel plated with cadmium from a cadmium cyanide solution) was washed with soap and water and placed in the 12-foot flow track cell of Unit 2. After 39 hours of operation, hydrogen output was 12% and adiponitrile selectivity was down to 86.7%. The cathode was fouled.

EXAMPLE 5

A cathode identical to that used in Example 4 was washed with soap and water as in Example 4; then washed (while in the cell) of Unit 2 with a 50 volume % water/50 volume % concentrated phosphoric acid solution, and then rinsed with water. After 39 hours of running under conditions similar to those of Example 4, the adiponitrile selectivity was 88.3% and the hydrogen output was 7%. Hydrogen output increased to only 9% at the conclusion of 183 hours of run, at which time the average adiponitrile selectivity was 87.6%. At the conclusion of this period, the cathode was found to be clean and bright on opening the cell.

EXAMPLE 6

(Comparative Example)

A commercially produced cathode (cadmium plated carbon steel) produced from a solution other than cadmium cyanide (but of unknown constituency) was washed with soap and water and placed in the electrolysis cell of Unit 2. After 62 hours of running, the hydrogen output was above 20% and increasing; and the selectivity to adiponitrile was 82.8%. Inspection of the cathode surface showed it to be moderately fouled.

EXAMPLE 7

A similarly commercial cathode was washed with soap and water, placed in the electrolysis cell of Unit 2 and in-placed washed with the same phosphoric acid solution employed in the preceeding examples together with 300 parts per million potassium iodide solution; and subsequently rinsed with water. After 62 hours of running, the hydrogen output was 5%, and the selectivity to adiponitrile was 86.7%. This run was continued for a period of 164 hours at which time no fouling was reported when the cell was opened.

We claim:

1. In a process for the production of adiponitrile from acrylonitrile by electrolytic dimerization in an electrolytic cell containing a dimerization electrolyte and electrodes comprising carbon steel anodes, and cathodes, at least a portion of which cathodes are metal plated, and which cathodes, after prolonged exposure to the dimerization electrolyte during the electrolyte dimerization process, become fouled, and where such fouling interfers with the electrolytic dimerization, the improvement comprising pretreating before dimerization the plated cathode by wetting the surface of the cathode with an aqueous phosphoric acid solution containing potassium iodide.

2. The process of claim 1 where the aqueous phosphoric acid comprises 25–75% by volume water and 75–25% concentrated (85 weight %) phosphoric acid.

3. The process improvement of claim 1 wherein the cathodes are cadmium-plated steel.

4. The process improvement of claim 1 wherein the cathode is cadmium-plated carbon steel and the anode is unplated carbon steel.

5. The process of claim 1 wherein the potassium iodide is present in the phosphoric acid solution in the amount of about 100–500 ppm potassium iodide.

* * * * *